US005465691A

United States Patent [19]

Capaldo

[11] Patent Number: 5,465,691

[45] Date of Patent: Nov. 14, 1995

[54] VALVE GUIDE

[76] Inventor: Richard G. Capaldo, 97 West Street, Torrensville, South Australia, Australia

[21] Appl. No.: 400,653

[22] Filed: Mar. 8, 1995

[51] Int. Cl.[6] ..... F01L 3/08

[52] U.S. Cl. ..... 123/188.9; 123/196 M; 251/339; 251/355

[58] Field of Search ..... 123/188.9, 196 M; 251/339, 355

[56] References Cited

U.S. PATENT DOCUMENTS

| | | | |
|---|---|---|---|
| 1,876,160 | 9/1932 | Zahodiakin | 123/188.9 |
| 3,581,728 | 6/1971 | Abraham | 123/188.9 |
| 3,809,046 | 5/1974 | Kammeraad | 123/188.9 |
| 3,828,756 | 8/1974 | Kammeraad | 123/188.9 |
| 4,103,662 | 8/1978 | Kammeraad | 123/188.9 |
| 4,695,061 | 9/1987 | Meisner et al. . | |
| 4,768,479 | 9/1988 | Kammeraad | 123/188.9 |
| 5,140,956 | 8/1992 | Seward | 123/188.9 |
| 5,249,555 | 10/1993 | Kammeraad | 123/188.9 |

FOREIGN PATENT DOCUMENTS

| | | |
|---|---|---|
| 445509 | 2/1974 | Australia . |
| 8683175 | 11/1975 | Australia . |

*Primary Examiner*—Henry C. Yuen
*Assistant Examiner*—Erick Solis
*Attorney, Agent, or Firm*—Watts, Hoffmann, Fisher & Heinke Co.

[57] ABSTRACT

A valve guide (14) for guiding a stem (13) of a headed poppet valve (11) for slidable movement in an internal combustion engine has an inner bearing surface (17) of generally cylindrical shape but a groove (18) which is cut spirally into that surface extends radially outwardly therefrom and provides a lubricant passage which extends for at least part o the length of the bearing surface (17). The cross-sectional shape of the spiral groove (18) is characterized by a lower groove portion (21) which is substantially at right angles to the stem (13) and functions to scrape lubricant off the stem (13) and as he stem (13) moves downwardly in the valve opening direction, but the upper surface portion (22) of the groove (18) back into clearance space between the valve stem (13) and guide (14).

4 Claims, 2 Drawing Sheets

VALVE GUIDE

This invention relates to a valve guide for guiding a valve stem of a headed poppet valve for slidable movement in an overhead type of internal combustion engine.

Even in water cooled engines there are heat problems which occur because of the high temperature of combustion within a combustion chamber, and that temperature can expand the diameter of a valve stem. Those problems increase quite considerably when the engine is aircooled because the engine components usually run at a higher temperature.

BACKGROUND OF THE INVENTION

It is obviously necessary for lubrication to exist in the form of an oil film between the valve stem and guide, and in some engines a large clearance exists between valve stem and guide such that the lubricant can pass the valve stem and enter the combustion chamber. Standard tolerances for the average "free running fit" diameters, such as might otherwise be commonly encountered in air cooled motor cycle engines, range from a maximum of 0.003 inches (United States standards) to a maximum of 0.0018 inches (British standards), and yet is known that some motorcycles have the minimum valve stem clearance of 0.003 inches, and quite often the minimum recommended clearance is 0.005 inches. Such clearances are sufficient to allow oil to enter the combustion chamber, but this is undesirable for the following reasons:

a. smoke emissions from the exhaust;

b. fouling of spark plugs;

c. excess carbon build up on piston crowns which may glow red hot causing pre-ignition;

d. carbon particles depositing between the valve head seat and valve and cause valves to burn out;

e. depletion of sump oil;

f. interference with correct air/fuel mixture which can cause loss of power; and g. contamination of sump oil which can result in overall reduced engine life.

This is a problem which has attracted a great deal of attention by engine designers, and there is a large amount of recorded art which relates to the design and lubrication of valve stems and guides. Notwithstanding all the efforts which have been made, however, it is still not uncommon for engines to encounter valve difficulties, and bent or otherwise damaged valve stems are frequently the cause of engine failure.

If lubricant does not enter the valve guide around the valve stem, the likelihood of engine failure due to seizure of the valve stem within its guide is very high.

Thus a problem exists in ensuring that some lubricant is always present throughout the whole of the length of a valve stem and guide, and yet to ensure that the amount of lubricant which finally reaches the combustion chamber is minimal.

PRIOR ART

A search conducted on behalf of the Applicant revealed that spiral grooves had been invented some time ago, and for example Australian Patent 445509 in the name of Caterpillar Tractor Co describes the use of a spiral groove for lubrication purposes. The advantage of a spiral groove over a number of circular grooves is that the spiral groove is a continuous flow path for lubricant between the valve and valve stem.

Australian Patent Application No 86831/75 in the name of Societe D'Etudes De Machines Thermiques disclosed the use of annular cavities to function as small reservoirs to ensure that lubricant existed for the whole of the length of the bearing surfaces of valve stems and guides.

The U.S. Pat. No. 4,695,061 in the name of Eagle-Picher Industries related not to a valve stem and guide, but related to a valve seal to go on top of the valve guide, and that valve seal was characterised by alternating grooves and lands which surrounded the valve stem. The lands had frustoconical surfaces and opposed surfaces on each land had different angular relationships to the axis of the valve stem to promote the flow of lubricating oil in the downward direction from top of a valve guide. The latter is the only reference which is known to the Applicant wherein the lands actually caused entrainment of the lubricant about the valve stem during its reciprocating movement, and the lands were angled so that there was entrainment on the downward stroke of the valve stem (valve opening) and less entrainment on the upward stroke. This functioned to regulate the lubricant supply between valve guide and stem. It actually worked in a reverse direction from the direction which is described in this specification, which relates to the valve guide itself.

It is well known that there is a large amount of available lubricant under the rocker cover of an engine, for lubricating valve guides and stems in the valve area of an overhead valve internal combustion engine, and both the Caterpillar and Eagle-Picher specifications made use of that lubricant. In contrast Patent 86831/75 utilised a circulating lubricant system.

BRIEF SUMMARY OF THE INVENTION

Briefly in this invention, a valve guide for guiding a stem of a headed poppet valve for slidable movement in an internal combustion engine has an inner bearing surface of generally cylindrical shape but a groove which is cut spirally into that surface extends radially outwardly therefrom and provides a lubricant passage which extends for at least part of the length of the bearing surface. The cross-sectional shape of the spiral groove is characterised by one groove portion which is substantially at right angles to the stem and functions to scrape lubricant off the stem and as the stem moves downwardly in the valve opening direction, but the upper surface portion of the groove defines an acute angle with the valve stem so that upon the valve stem moving upwardly in the valve closure direction, lubricant is again entrained from the groove back into clearance space between the valve stem and guide.

Extensive tests have been undertaken by the Applicant herein, and when valve guides made in accordance with this invention were inserted in an engine notorious for valve stem and guide failure, the results were surprisingly successful, and even when "tightly fitted" with much less clearance than recommended, no seizure of valve stem was experienced.

Without use of this invention, a small clearance is well known to increase the risk of breaking down oil film resulting in metal to metal contact which will cause seizure or irreparable physical mechanical damage. On the other hand, if the clearances are excessive, while more oil can pass between the valve stem and guide, nevertheless the valve stem can waver or rock from side to side in the valve guide, squeezing the oil film away and still causing a metal to metal contact. Rapid wear of the valve guide can be expected.

Applicant's tests have indicated that with less clearance than normally recommended by manufacturers, use of this invention will increase the life of valve guides, and reduce problems associated with excessive clearance.

DETAILED DESCRIPTION OF THE DRAWINGS

An embodiment of the invention is described hereunder in some detail with reference to and is illustrated in the accompanying drawings in which.

Figure 1:
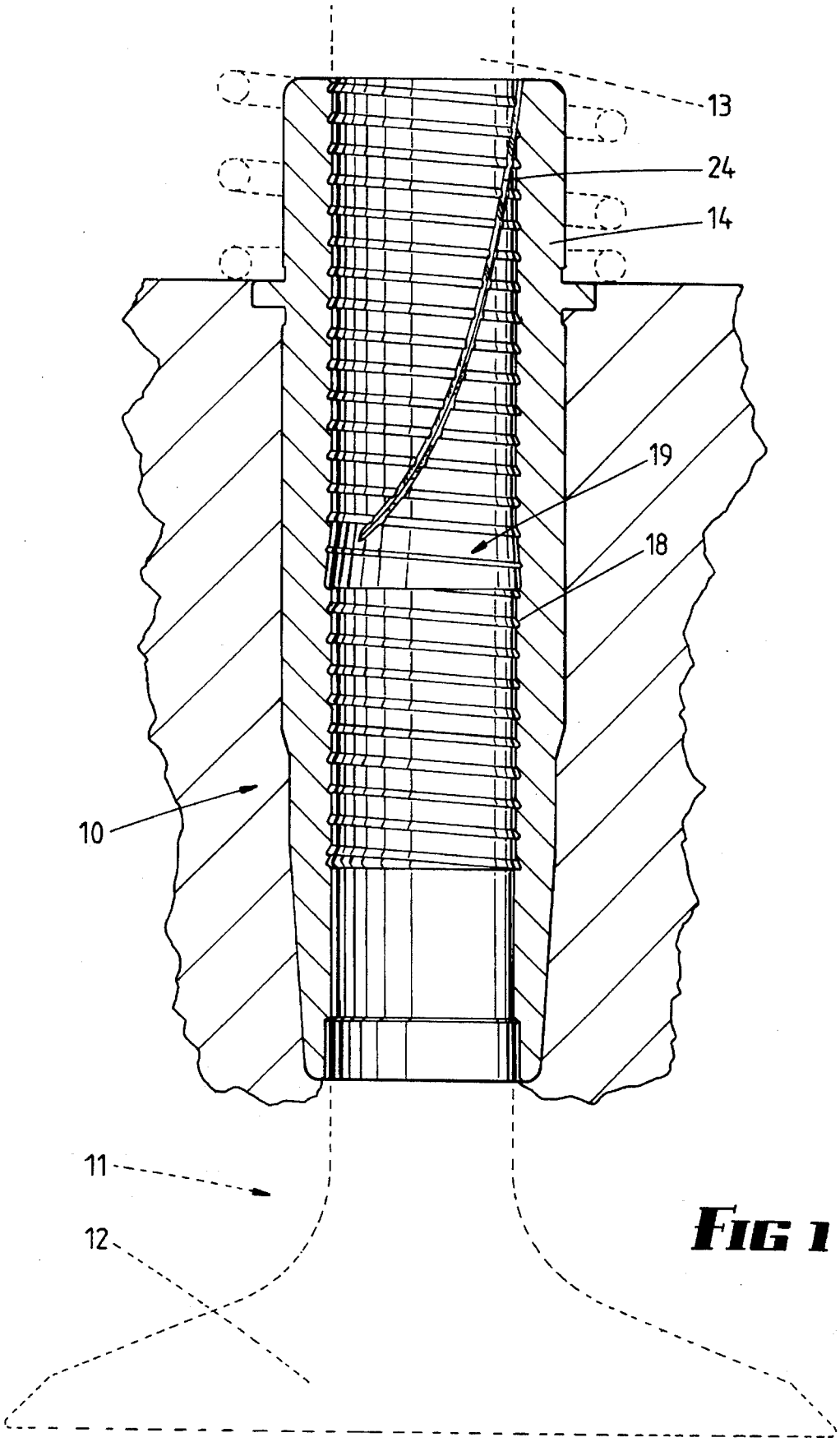
FIG. 1 is a section through a valve guide, and showing in dashed lines the valve stem and head of a poppet valve as commonly used in an internal combustion engine.
Figures 2, 3, 4:
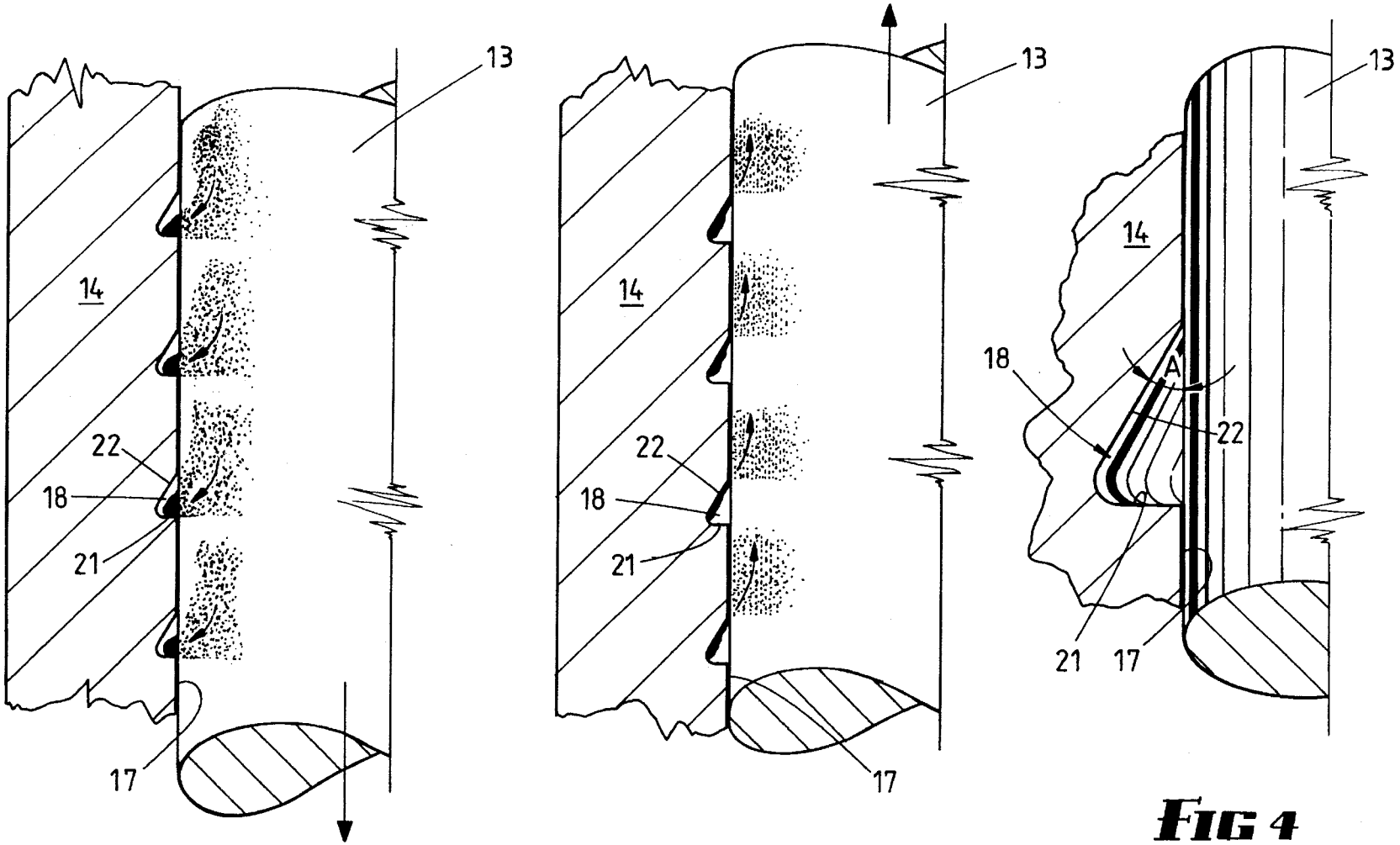
FIG. 2 is a fragmentary section taken on the same plane as FIG. 1 and showing how downward movement of the valve stem will cause the lubricant to be scraped from the stem and into the groove.

FIG. 3 is a view similar to FIG. 1 showing how the upward movement of the valve stem will entrain the liquid lubricant to again enter the clearance space as an oil film between the upwardly moving stem and the valve guide; and FIG. 4 shows to a greatly increased scale the shape of a groove so as to illustrate the portion which extends generally radially outwardly from the valve stem and the portion which defines an acute angle to the valve stem.

It will be understood by those skilled in the art that the drawings are all larger than scale, FIGS. 2 and 3 being much larger than FIG. 1 and FIG. 4 being much larger than either FIGS. 2 or 3. This is for demonstration of the function of the invention.

FIG. 1 shows an assembly 10 comprising a conventional poppet valve 11 having a head 12 and a valve stem 13 which is guided for sliding movement by the valve guide 14 of this invention.

The valve guide 14 is manufactured from bronze which has the dual advantage of being a good bearing metal and having much higher heat conductivity than steel. It also has a higher coefficient of expansion so that upon heating, there is less likelihood of the running clearance being diminished.

The inner surface of the valve guide 14 comprises a bearing surface 17 of generally cylindrical shape, the bearing surface extending for most of the length of the valve guide 10. However, the bearing surface is interrupted by a spiral groove 18 which extends from the top to the bottom of the bearing part of the valve guide 14, except for an annular groove 19 which performs a function of a small well or reservoir to ensure that ample lubricant is delivered to the lower end of the valve guide 14. There is thus a continuous oil flow path from the top of the valve guide where the oil is plentiful to the lower end of the stem 11, but the oil flow rate is regulated by the reciprocating movement of the valve stem 13.

It is believed that the cross-sectional shape of the groove 18 is of major importance. Groove 18 is defined by a groove surface which has two different angles of intersection with the bearing surface 17. The lower portion of groove 18 is designated 21 (that is, the portion closest the head 12) for the axially inner groove surface. This extends generally outwardly radially, and merges into an upwardly sloping upper groove surface portion 22 which is more distant from the valve head, and consequently defines with the stem 13 the acute angle A. FIG. 2 shows how the lower portion 21 will "scrape" the lubricant from downwardly moving valve stem 13, and that lubricant will be delivered back into the groove 18. However, as the valve stem 13 reverses direction upon closure of the valve, the lubricant will tend to become entrained as shown in FIG. 3, between the bearing surface 17 and the valve stem 13. The angles defined between the respective surfaces 21 and 22 on the one hand and the outer surface of the valve stem 13, the cross-sectional area of the groove 18, and the pitch of the groove 18 are all available parameters which a designer can vary to control the distribution of lubricant over the bearing surface. However, there are still other variables outside the control of the designer, and these include the viscosity of the oil, the temperature of the valve stem, the engine speed, and the ambient temperature and conditions. For example, ice and snow washing over the exterior of an engine can tend to cause some shrinkage of the bronze valve guide 14 while the stem 11 is getting hotter. It is one of the conditions which is sometimes encountered which may cause seizure of an unlubricated or poorly lubricated valve stem and guide assembly. It is therefore very desirable, although not always essential, that the annular groove 19 should be employed to function as a small reservoir to hold oil between the upper and lower ends of the valve guide 14. In most instances, there will be ample oil flow through a well designed groove 18, but if conditions are likely to be encountered where the groove 18 may become blocked with debris from the lubricating oil or for any other reason at all, use can be made of a secondary groove 24 leading to the annular groove 19 from the upper end of the valve guide 14. This is an option which, although available, will be unlikely to be used, if the test results of the Applicant are indicative of performance.

In addition to the beneficial effects which are achieved and mentioned above, it has been found that there are some unexpected beneficial effects.

One test indicated that one might expect that a tightly fitted stem into a valve guide according to this invention, will not only be found to run smoothly and satisfactorily, but a valve guide life may be increased by a factor or more than 2.

Because of the closer tolerances, a seat in the cylinder head can be machined more accurately to the centre of the guide bore axis, giving greater seating ability and accurate seating control. Since there is less tilting of the valve and the valve remains more nearly concentric with the valve seat, there is less wear on the valve seat and consequently there is less maintenance. Good lubrication can be maintained over a very wide range of temperatures and speeds, and because of improved lubrication, there appears to be less fatigue on the metals and on the mating surfaces associated with the valve.

I claim:

1. A valve guide for guiding a valve stem of a headed poppet valve for slidable movement in an internal combustion engine, comprising an inner bearing surface of generally cylindrical shape, a groove surface defining a spiral lubricant passage from an end of the guide towards the valve head extending for at least part of the length of bearing surface, the cross-sectional shape of said spiral groove comprising an axially inner groove surface portion closest the head of said valve which extends generally radially outwardly from said bearing surface to be effective in scraping lubricant from said valve stem into said groove upon stem movement in a valve opening direction, and said shape also comprising an axially outer groove surface portion more distant from said valve head defining an acute angle with said valve stem to be effective in causing entrainment of lubricant from said groove by said stem upon stem movement in a valve closure direction.

2. A valve guide according to claim 1 wherein said spiral lubricant passage terminates at ends of said inner bearing surface.

3. A valve guide according to claim 1 comprising a reservoir forming surface defining an annular groove between ends of said spiral groove for retention of lubricating oil.

4. A valve guide according to claim 3 wherein said groove surface intersects ends of said reservoir forming surface so that said spiral lubricant passage opens into, and is interrupted by, said reservoir forming surface.

* * * * *